US005465672A

United States Patent [19]

Boyse et al.

[11] Patent Number: 5,465,672

[45] Date of Patent: Nov. 14, 1995

[54] WRAPPED DECK PALLET

[75] Inventors: George C. Boyse, Rocklin, Calif.; Steven R. Morgan, Hurricane, W. Va.

[73] Assignee: Down River International, Inc., Sacramento, Calif.

[21] Appl. No.: 243,383

[22] Filed: May 16, 1994

[51] Int. Cl.[6] ..... B65D 19/00

[52] U.S. Cl. ..... 108/51.3; 108/56.1

[58] Field of Search ..... 108/51.3, 51.1, 108/56.1, 56.3; 206/386, 597, 600

[56] References Cited

U.S. PATENT DOCUMENTS

| | | | |
|---|---|---|---|
| 1,685,813 | 10/1928 | Greve . | |
| 2,576,715 | 11/1951 | Farrell . | |
| 2,894,671 | 7/1959 | Nicholls | 108/51.3 X |
| 2,902,199 | 9/1959 | Breton . | |
| 2,906,481 | 9/1959 | Parker | 108/51.3 |
| 2,925,947 | 2/1960 | Brown . | |
| 2,996,276 | 8/1961 | Sorensen et al. . | |
| 3,026,078 | 3/1962 | Simkins | 108/51.3 |
| 3,302,593 | 2/1967 | Roberts . | |
| 3,425,367 | 2/1969 | Oravez . | |
| 3,480,196 | 11/1969 | De Simas . | |
| 3,666,165 | 5/1972 | Osborne et al. . | |
| 3,695,426 | 10/1972 | Engelsberger | 206/597 X |
| 3,730,417 | 5/1973 | Lawson | 206/597 X |
| 3,952,672 | 4/1976 | Gordon et al. | 108/51.3 |
| 4,228,744 | 10/1980 | Moore . | |
| 4,390,154 | 6/1983 | Ostler et al. | 108/51.3 X |
| 4,875,419 | 10/1989 | Helton et al. . | |
| 4,972,782 | 11/1990 | Shepherd et al. . | |
| 4,979,446 | 12/1990 | Winebarger . | |

FOREIGN PATENT DOCUMENTS

| | | | |
|---|---|---|---|
| 2639027 | 5/1990 | France | 206/600 |
| 4314504 | 12/1993 | Germany | 108/51.3 |
| 1355498 | 6/1974 | United Kingdom | 108/53.3 |

*Primary Examiner*—Kenneth J. Dorner
*Assistant Examiner*—Janet M. Wilkens
*Attorney, Agent, or Firm*—Harness, Dickey & Pierce

[57] ABSTRACT

An improved wrapped deck pallet assembly is provided which is comprised of an envelope having smooth exterior surfaces and an internal support structure nested within the envelope for enhancing the overall strength of the wrapped deck pallet. In the first embodiment, the envelope has a base, side walls and four flaps, and is formed such that the flutes of the base and the flutes of the flaps are running in a non-parallel angular or perpendicular direction to one another when the envelope is folded. The internal structure includes optional top and bottom flat paperboard decks that sandwich a plurality of blocks to form an internal rigid structure located within the envelope. Preferably the flutes of the top deck will be oriented to extend in a non-parallel angular direction or perpendicular to the flutes of the top flaps of the envelope. A second embodiment employs the same internal rigid structure however, an envelope of different configuration is employed which has a pair of elongated flaps which nest together to form a smooth exterior configuration. Yet another embodiment is disclosed which uses a plurality of elongated reinforced structures that are sandwiched between a top deck and a bottom deck on the base of the envelope. The resulting pallet has superior strength properties when compared to pallets made of conventional designs and also reduces the likelihood of portions of the internal support structure being dislodged and/or lost.

27 Claims, 4 Drawing Sheets

FIG-3
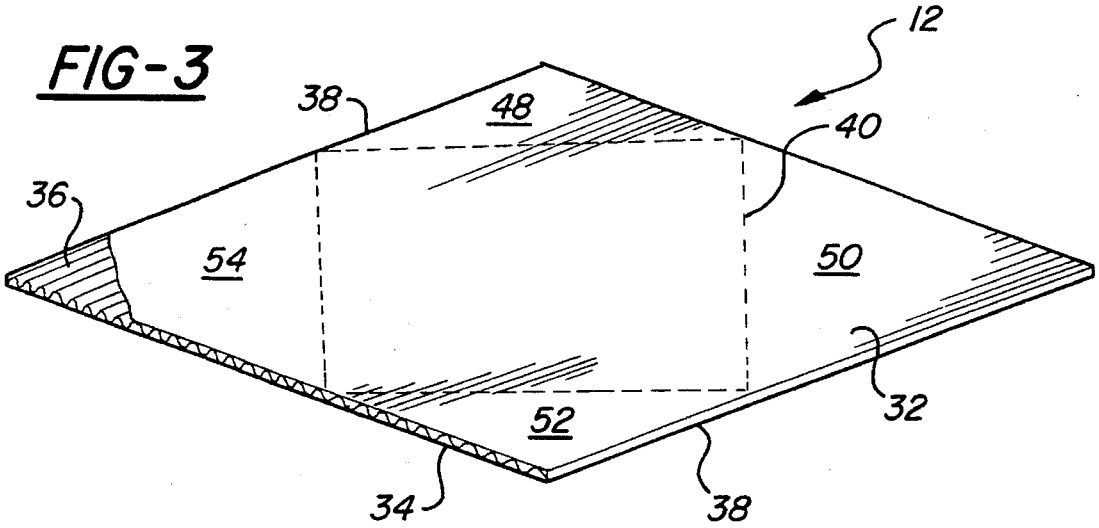
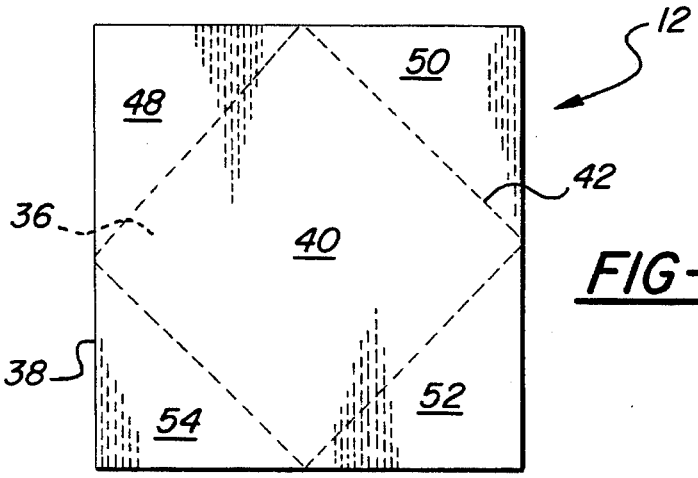
FIG-4
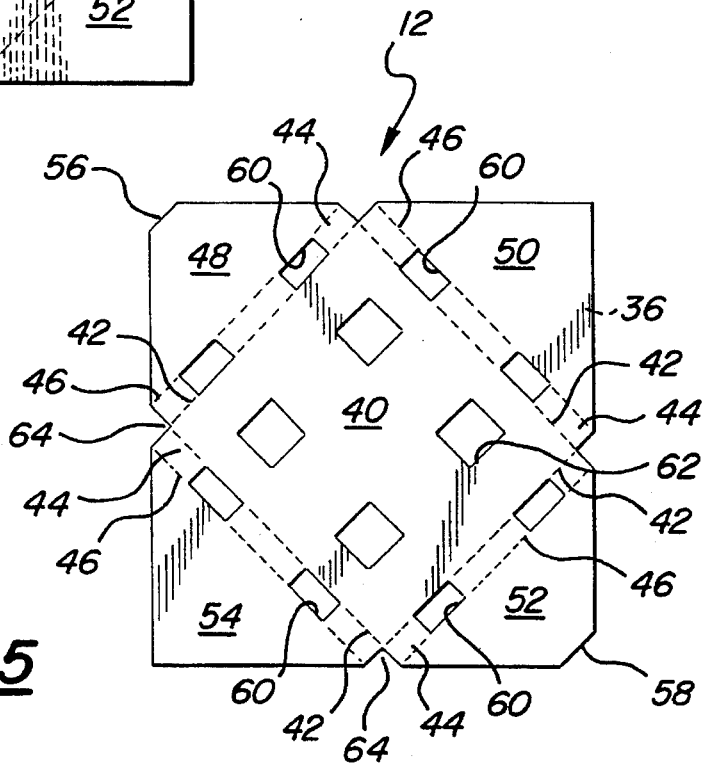
FIG-5

WRAPPED DECK PALLET

FIELD OF THE INVENTION

The present invention relates generally to paperboard pallets, and more particularly, to a wrapped deck pallet formed of corrugated paperboard.

BACKGROUND OF THE INVENTION

Pallets have been well-known for their use in the shipping and the storage industries for transporting various goods that are used in commerce. For many years the shipping industry has preferred to use wooden pallets. Presently, lightweight paperboard pallets are the preferred form for many in the shipping industry. A sample of the various pallets and paperboard structures used for shipping purposes are shown in the following United States Patents: U.S. Pat. Nos. 1,685,813; 2,576,715; 2,902,199; 2,925,947; 2,996,276; 3;302,593; 3,425,367; 3,480,196; 3,666,165; 3,952,672; 4,228,744; 4,390,154; and 4,972,782.

The problem with some of the above-mentioned conventional shipping structures is that they often have rough exterior surfaces which are likely to snag a person's clothes. These rough exterior surfaces also make it difficult to insert or remove pallets from a pallet dispenser. Furthermore, these shipping structures do not provide the structural rigidity and the simplistic design as offered in the present invention. It is desirable to have a pallet that offers the rigidity of a wood pallet while minimizing the weight of the pallet as much as possible. By minimizing the weight of the pallet, shipping costs are held to a minimum.

In light of the above-mentioned problems, it would be desirable to have a wrapped paperboard pallet that offers a dynamic strength that out performs paperboard pallets that utilize the same material under conventional designs. It would further be desirable to provide a wrapped paperboard pallet that is simple in design, cost effective, lightweight and is presented in a configuration having smooth external surfaces. The smooth external surfaces offer the advantage of providing advertising spaces, reducing the risk of snagging clothes or injury to employees, as well as to make the pallet easy to handle in a pallet dispenser. Additionally, open sided prior art pallets are prone to dislodgement and loss of internal structural components by material handling equipment which results in a weakening and potential collapse of the pallet. Because the present invention substantially encloses the internal structural components, they are substantially less prone to being dislodged and even should they become dislodged, they will still be contained within the structure thus reducing the likelihood of excessive weakening of the pallet. And finally, it would be desirable to provide a pallet that may be easily recycled.

SUMMARY OF THE INVENTION

It is an object of the present invention to provide a wrapped deck pallet for storage and shipping purposes that overcomes the problems mentioned above. The wrapped deck pallet should be lightweight in design yet yield significant dynamic strength when compared to conventional pallet designs.

A first preferred form of the invention provides as one of its aspects, a novel paperboard wrapped deck pallet assembly comprised of a unitary envelope preferably made of three-ply corrugated paperboard or the like that has flutes defined by a longitudinally extending corrugated member.

The envelope has a base portion with side walls extending generally vertically from the base and a plurality of flaps extending from the side walls wherein the flaps fold together in a nested relationship to define a smooth upper surface. In one form when the envelope is dosed, the flutes of the flaps are perpendicular to the flutes of the base which results in an envelope having superior strength with respect to conventional pallet designs. The use of an optional inner deck member adjacent the flaps and having flutes running generally perpendicular to the flutes of the flaps further improves the strength of the pallet.

The wrapped deck pallet assembly is further comprised of an internal assembly which may include either an optional upper and/or lower deck member preferably of a paperboard material such as a three-ply corrugated paperboard that sandwiches a plurality of spaced-apart blocks. This internal assembly can be preassembled and easily placed within the envelope prior to the closing of the flaps of the envelope. The resulting structure is rigid, lightweight and simplistic in design.

A second preferred form of the present invention provides as one of its aspects, a wrapped deck pallet which is comprised of a unitary paperboard envelope having a base with side sections extending vertically therefrom. A pair of elongated flaps and a pair of shortened flaps are connected to the side sections where the elongated flaps define a smooth top surface once folded. The envelope is made of the same paperboard as discussed above however, it is formed from a blank piece of paperboard such that the flutes for the base, the walls and the flaps are parallel with one another when the envelope is folded.

The second preferred form of the present invention is further comprised of an internal assembly made of a plurality of spaced-apart blocks. An optional upper and/or lower deck may also be included. This internal assembly is located within the envelope and the flaps are folded such that a rigid wrapped pallet is provided having smooth exterior surfaces. Preferably the top deck if included will include flutes extending generally perpendicular to the flutes of the flaps and the lower deck if present will have its flutes extending in a direction perpendicular to the flutes of the top deck or bottom surface of the envelope if no top deck is utilized.

In both forms discussed above, all four side walls of the envelope are preferably provided with clearance holes for receiving the tangs of material handling equipment which enhances the maneuverability of the wrap deck and the contents stored upon it.

A third preferred form of the present invention may be used with either the envelope of the first or second above-mentioned forms and comprises a unique elongated corrugated block sandwiched between the top and bottom inner surfaces of the deck or the top deck and/or bottom or lower deck if present. This embodiment employs three elongated blocks to be used with each internal assembly which adds additional rigidity to the overall pallet assembly. Notches are provided in the sides of each elongated block and act as clearance holes for receiving the tangs of material handling equipment.

From the following specification taken in conjunction with the accompanying drawings and appended claims, other objects, features and advantages of the present invention will become apparent to those skilled in the art.

BRIEF DESCRIPTION OF THE DRAWINGS

FIG. 3 is a perspective view of a blank piece of corrugated paperboard from which the envelope of the wrapped deck pallet is formed from;

FIG. 4 is a top plan view of the FIG. 3 blank of corrugated paperboard illustrating the orientation of the flutes with respect to the base of the envelope;

FIG. 5 is a top plan view of the deck pallet shown in FIG. 4 illustrating the various perforations and cut-outs performed on the envelope;

It will be understood that for purposes of clarity, certain elements may have been intentionally omitted from a certain view in order to enhance the understanding of the present inventions.

DETAILED DESCRIPTION OF THE PREFERRED EMBODIMENT

The disclosed wrapped deck pallet is designed to maximize the dynamic strength of the overall pallet as well as to provide an aesthetically pleasing pallet that has smooth exterior surfaces. It will be understood that the following detailed description of the preferred and alternative embodiments are merely exemplary in nature and is in no way intended to limit the invention, its application or uses.

Figure 1:
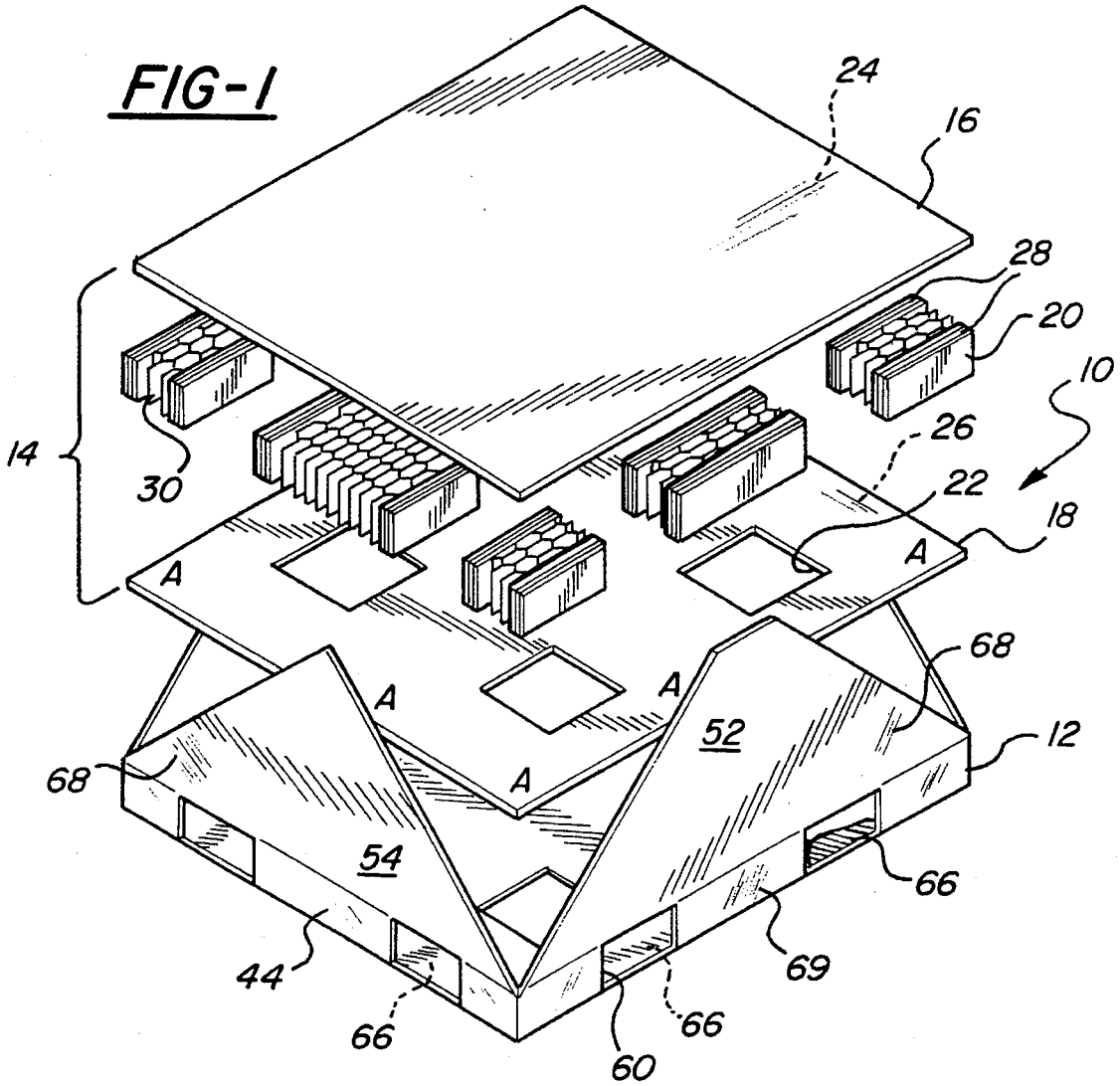
FIG. 1 is an exploded perspective view of the wrapped deck pallet illustrating the primary components of the present invention with portions thereof being broken away.
Figure 2:
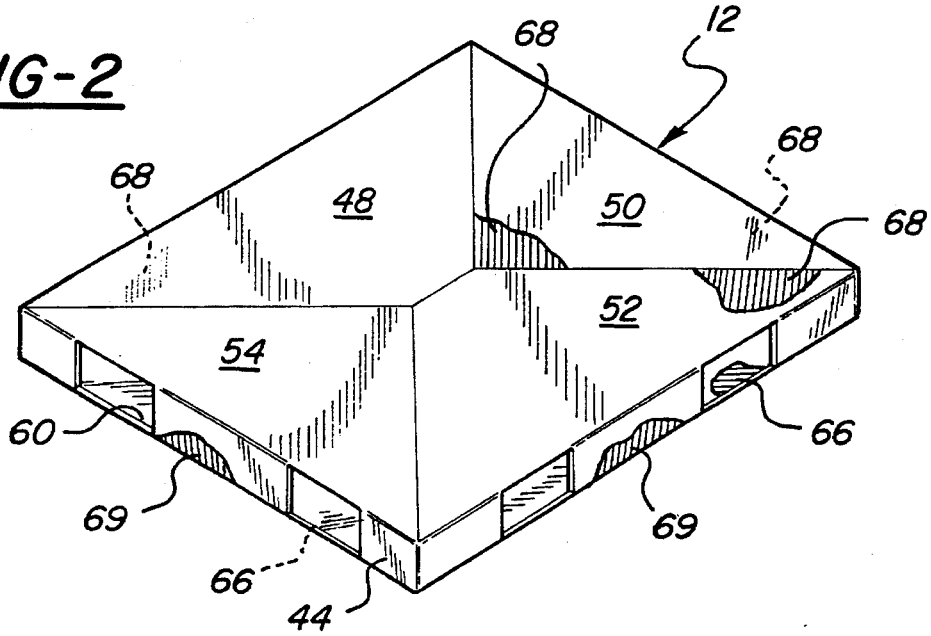
FIG. 2 is a perspective view of the present invention illustrating the wrapped deck pallet in its assembled form ready for use also with portions thereof broken away.

With particular reference to FIG. 1, the primary components of the wrapped deck pallet assembly 10 are shown in an exploded perspective view. The primary components of the wrapped deck pallet assembly 10 preferably includes a corrugated paper envelope 12 that is of sufficient size to receive an internal structural assembly 14. The assembly 14 in a preferred form is comprised of an upper deck 16 and a lower deck 18 which together sandwiches a plurality of core blocks 20. The internal assembly 14 may be pre-assembled and then inserted within the envelope 12 where the flaps of the envelope are folded and sealed to the upper deck 16 to form a clean package as shown in FIG. 2. It should be noted, however, that if desired either the top deck or lower deck or both may be omitted. If only one deck is used, the blocks may be preassembled thereto and the resulting assembly inserted within the envelope. If no decks are used, the blocks will be individually placed within the envelope.

The optional upper deck 16 and the bottom deck 18 are preferably made of a three-ply paperboard material. It will be appreciated, however, that the design of the present pallet may be easily modified, for example, by utilizing flat decks made of other than three-ply paperboard. It will further be appreciated that multiple-ply flat decks having corrugations may be used. If this is the case, each flat deck should be oriented such that its flutes 24 and 26 are positioned perpendicular to one another. This design will enhance the overall rigidity and strength of the wrapped deck pallet assembly 10. The bottom deck 18 and envelope preferably have four holes 22 and 62 respectively formed therein which are specifically positioned so as to accommodate wheels provided on certain material handling equipment such as pallet jacks. Holes 22 and 62 are aligned with each other and enable the wheels of such material handling equipment to directly engage the floor or underlying support surface. These holes also serve to further reduce the weight of the pallet.

Figure 7:
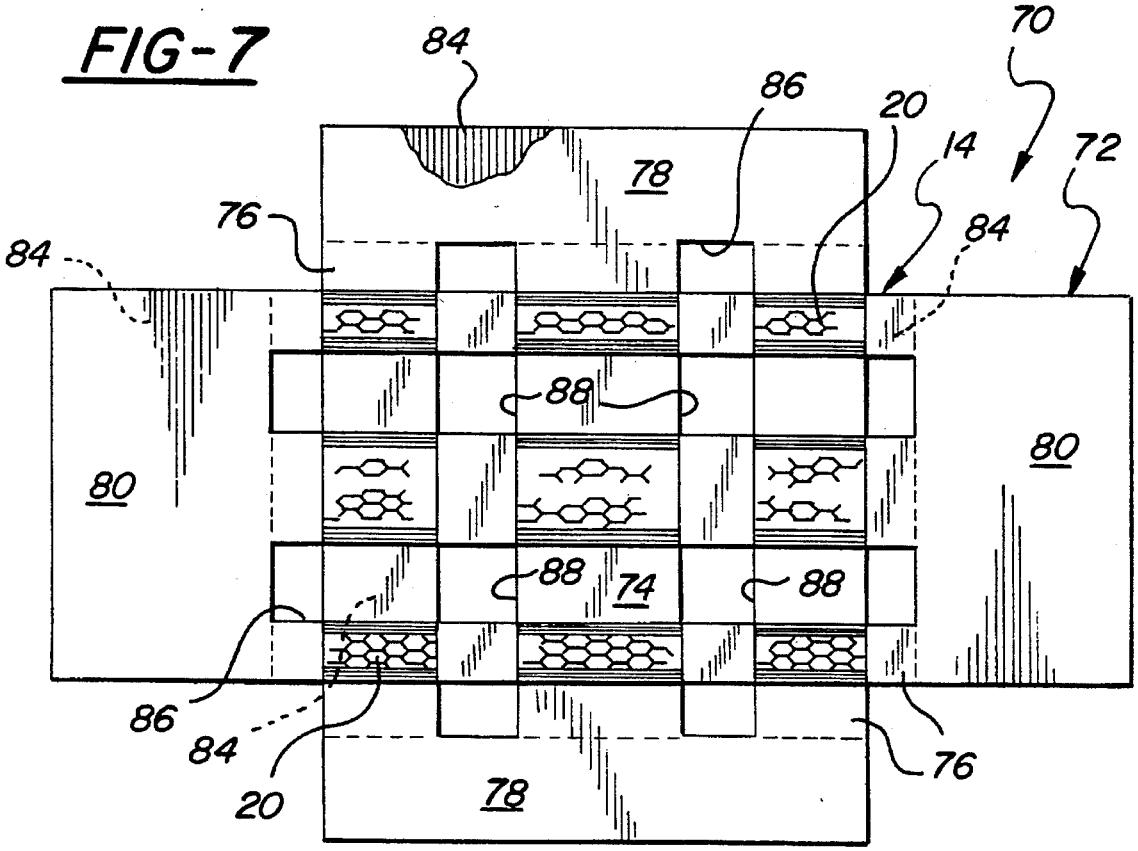
FIG. 7 is a top plan view of the FIG. 6 wrapped deck pallet illustrating the envelope fold lines, the core blocks inserted on the base of the envelope and the flaps in their unfolded position, all with the decks removed for simplicity purposes.

The core blocks 20 are preferably comprised of a pair of spaced-apart multiple-ply paperboard panels 28 that sandwich a honeycomb-shaped paperboard structure 30. The core blocks 20 are designed such that they are capable of withstanding substantial forces in a vertical direction, thus, they have very significant crush strength properties. The present design preferably includes nine core blocks 20 strategically positioned at locations on the bottom of the envelope or flat deck 18 if present as indicated by the letter A for the five blocks illustrated. It will be appreciated that the remaining four blocks should be positioned in their respective corresponding positions as illustrated in FIG. 7.

As best seen in FIGS. 3–5, the envelope 12 is initially taken from a blank sheet of corrugated paperboard which preferably includes a three-ply design of substantially flat panels 32 and 34 that together, sandwich a corrugated layer 36. Here the blank has been provided at a size equal to the overall dimension of the envelope 12. It will be appreciated that blanks may be provided in single sheet form or removed from a continuous sheet of paperboard. FIG. 3 further shows a broken section of the top panel 32 where the corrugations, otherwise known as flutes 36, are illustrated extending the entire length of the blank in a direction parallel to outer edge 38. These flutes 36 are further shown in simplified form for reference purposes in FIGS. 4 and 5.

The envelope 12 preferably includes a base 40 that is defined by four internal fold lines 42 which are represented by dashed lines. Integral with the base 40 are four vertically extending side walls 44 which are defined by internal fold lines 42 and external fold lines 46. Four foldable flaps 48, 50, 52 and 54 extend outwardly from the respective side walls whereby flaps 48 and 52 have cutoffs 56 and 58. These cutoffs allow the flaps to nest together when folded so as to provide a smooth top surface as illustrated in FIG. 2.

The envelope 12 further has a plurality of cutouts 60 that are formed in each of the respective side walls 44 which serve as clearance holes for the tangs of a forklift or other material handling equipment to enter and pick-up the pallet 12. Also provided are a plurality of cutouts 62 located in the base 40 of the envelope which, as mentioned above, are designed to accommodate wheels of certain material handling equipment as well as aiding in reducing the overall weight of the deck pallet assembly. And finally, four notches 64 are positioned on the perimeter of the envelope 12 which define the height of the side walls 44.

The wrapped deck pallet assembly 10 may be easily assembled by first providing a blank piece of preferably corrugated paperboard although other like material may be used and forming an envelope 12 having the configuration as presented in FIG. 5. This step, for example, may be provided by utilizing a steel-rule die that can produce either single or multiple envelopes per press stroke. Next, assuming that both optional decks 16 and 18 are to be used, the internal structure assembly 14 may be preassembled, if desired, in order to enhance the production line assembly process. During this step, the core blocks 20 should be adhesively bonded to the upper deck 16 and the lower deck 18 in the positions indicated in FIG. 1. Once this assembly is secure, it should then be positioned within the envelope 12 whereby the flaps 48, 50, 52 and 54 can be appropriately folded to their closed positions and held in place by an adhesive. As mentioned above, if only one inner deck 16 or 18 is employed, core blocks 20 may be adhesively bonded thereto whereupon the resulting assembly can be placed in the envelope 12. The free ends of the core blocks 20 can also then be bonded to the opposed surface of the envelope. If no inner decks 16 or 18 are employed, core blocks 20 will be adhesively bonded directly to the opposed inner surfaces of the envelope 12. The resulting pallet is structurally rigid while having smooth continuous exterior surfaces free of snags and easy to handle. Such a pallet is also lightweight and is easy to maneuver by material handling equipment because of the access-way provided on all four sides.

It is important to orient the blanks in the die prior to cutting the envelope 12 such that the flutes are running in the direction as indicated in FIGS. 3–5. The resulting envelope 12, when folded, will have flaps with flutes that extend in a direction perpendicular to the flutes of the base 40. For example, flutes 66 (see the cut-away sections in FIGS. 1 and 2) extend in a direction perpendicular to the flutes 68 of each flap 48, 50, 52 and 54. Also, the direction of the flutes 69 in each side wall 44 is at oblique angles with the flutes 66 of the base 40. This design results in a superior wrapped deck which has improved strength over conventional pallet designs.

As may thus be appreciated the wrapped deck pallet assembly 10 provides a structure wherein all six sides of the assembly are enclosed by the single envelope with the edges of sidewalls 44 being positioned in close abutting relationship thus providing a relatively smooth exterior surface extremely well suited for use in automatic pallet dispensing apparatus. Preferably the top deck member will be oriented such that its flutes extend in a non-parallel angular direction or perpendicular to the flutes of the respective flaps. This arrangement further improves the overall rigidity and load carrying capacity of the pallet structure. In some applications it may be desirable to omit one or both of the inner deck members in which case the core blocks may be adhesively bonded to the opposed surface of the envelope and/or the remaining deck member if present.

Figure 6:
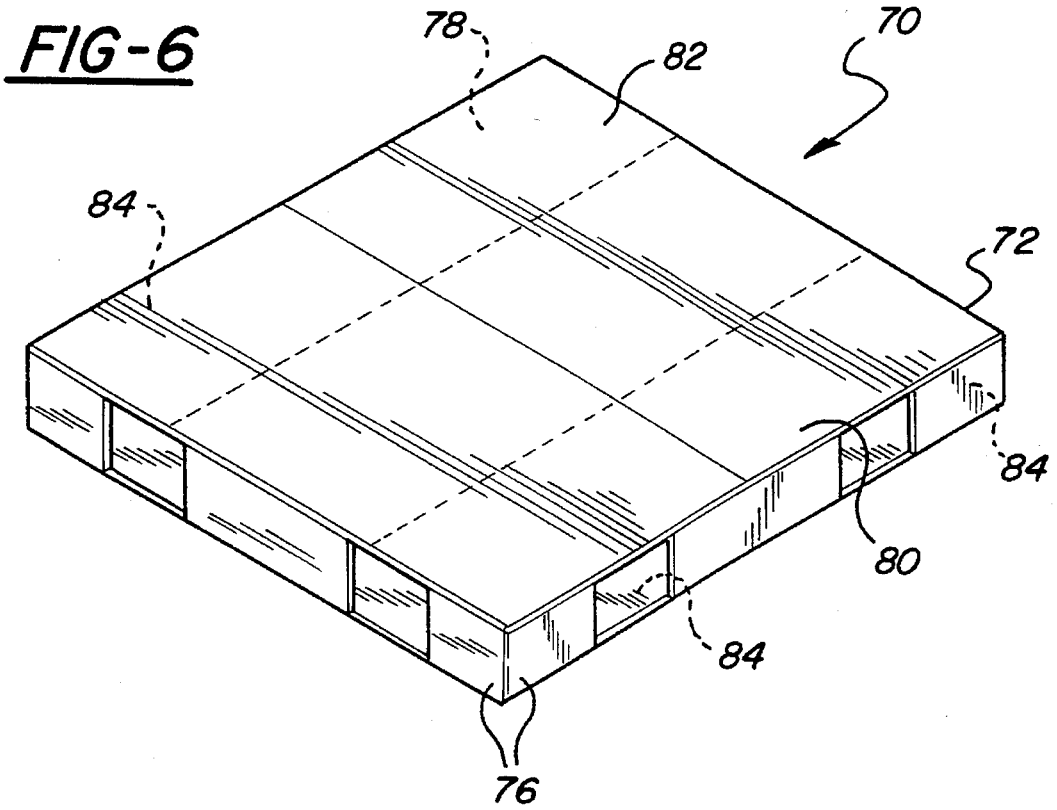
FIG. 6 is a perspective view of an alternative embodiment illustrating the wrapped deck pallet design.

Referring now to FIGS. 6 and 7, an alternative embodiment is disclosed which employs similar components as previously discussed herein. Where possible, like numbers will be used to represent the same elements. In this embodiment a wrapped deck pallet assembly 70 is illustrated having the primary components of an envelope 72 and an internal structural assembly 14.

The envelope is preferably made of a single piece of three-ply corrugated paperboard material and includes a base 74, four side walls 76 and a pair of shortened flaps 78 and a pair of elongated flaps 80, both extending from the side walls 76. This alternative embodiment differs from the first embodiment in that when the flaps 78 and 80 are folded (see FIG. 6), flaps 78 are recessed underneath the top surface 82 (as indicted by the hidden lines) while the elongated flaps 80 are nested together to define a smooth upper top surface 82. The resulting pallet has smooth exterior surfaces much the same as discussed above with respect to pallet assembly 10.

The envelope 72 is removed from a blank sheet of preferably three-ply corrugated paperboard in such a manner that the flutes 84 of the base 74, the side walls 76 and of the flaps 78 and 80, all run parallel to one another when folded and unfolded. This is yet another distinction between the first embodiment and the second embodiment.

The envelope 72 further has a plurality of cutouts 86 located within each of its four side walls 76 for the purpose of providing an access-way for the tangs of material handling equipment. Also provided are four cutouts 88 that accommodate wheels incorporated on certain material handling equipment as noted above and also lighten the envelope. Normally, you would not be able to see these cutouts 88 in the top plan view as illustrated in FIG. 7, however, for simplified purposes only, the upper deck 16 and the lower deck 18 have been omitted. Of course, the core blocks 20 are still illustrated in their proper position.

The wrapped deck pallet assembly 70 may be formed by first providing a piece of paperboard, preferably corrugated three-ply, and then producing the cutouts and fold lines as illustrated in FIG. 7. As discussed above, a steel-rule die may be used to provide these cutouts and the perforations (fold lines). Next the internal structural assembly 14 needs to be assembled, bonded together as previously discussed above and then inserted within the envelop 72. Adhesive may then be applied to the top deck 16 whereby flap 78 should be folded thereupon and then adhesive should be applied to flap 80 and then folded to make contact with flap 78. It will be appreciated it may be desirable to apply a clamping force to the finished wrapped deck for a period of time in order to allow the adhesive to bond. It will be further appreciated that other means may be used in order to keep the envelope sealed shut.

Additionally, as noted above, top deck 16 will preferably be oriented such that its flutes extend in a non-parallel angular or perpendicular direction relative to the direction of the flutes of flaps 78 and 80. Also if desired either or both the lower and upper deck may be omitted in which case the blocks may be secured directly to the base.

Figure 8:
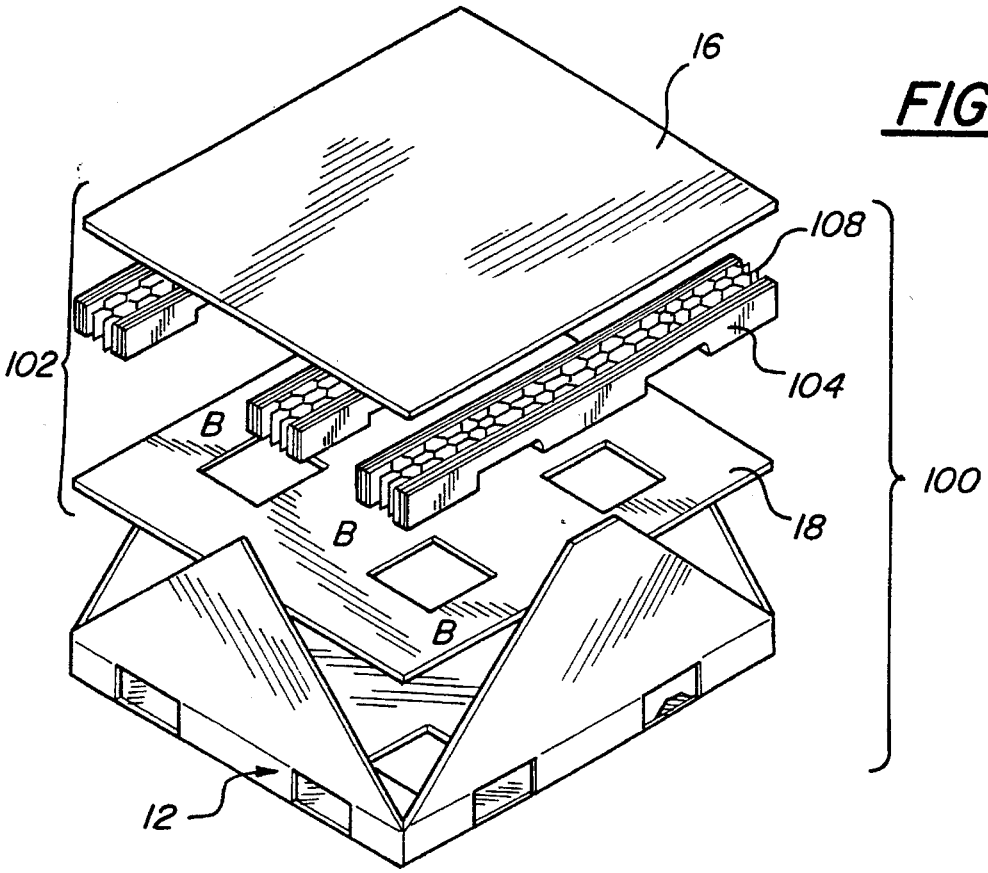
FIG. 8 is a perspective view of yet another alternative embodiment illustrating the wrapped deck pallet design.
Figure 9:
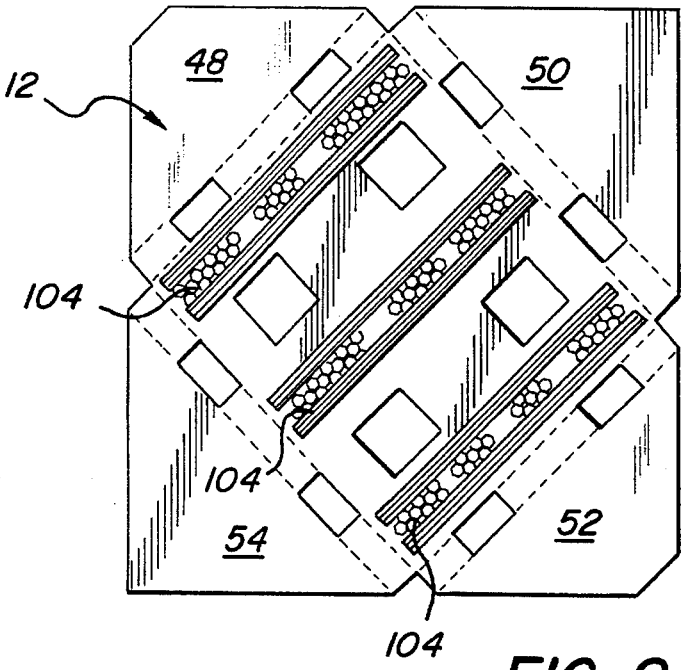
FIG. 9 is a top plan view of the envelope illustrated in FIG. 8 with the elongated blocks being properly positioned.
Figure 10:
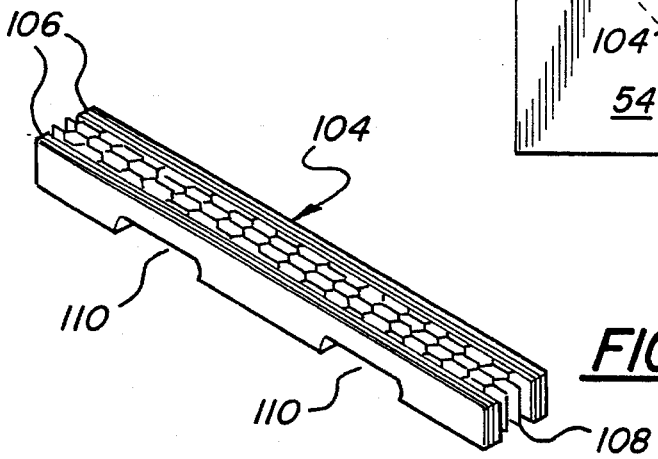
FIG. 10 is a perspective view of one elongated corrugated block.

Referring now to FIGS. 8–10, yet another alternative embodiment is disclosed which employs similar components as previously discussed herein. Accordingly, where possible like numbers have been used to represent the same elements. This embodiment illustrates a wrapped deck assembly 100 being used in conjunction with an envelope 12 and an internal structural assembly 102.

The primary difference between this third alternative embodiment and the previous two embodiments is that three elongated core blocks 104 are used in place of the nine smaller core blocks 20. Each elongated core block 104 is positioned at point B and sandwiched between top deck 16 and bottom deck 18 if employed or the opposed surface of the envelope and deck if only one deck is employed or lastly between the two opposed surfaces of the envelope if no decks are employed to create the assembly 102. It will be appreciated that the internal assembly 102 may be used with either envelope 12 or 72 as previously disclosed in the previous embodiments herein.

Referring to FIG. 10, each elongated core blocks 104 are preferably made of a pair of eighteen ply axially extending outside runners 106 that sandwich an eighteen ply 4½ to 5½ inch center cell 108. Of course as noted above, other suitable materials may be used to form elongated core blocks 104. Rounded off clearance holes 110 extend through the elongated core block 104 and provide an area for tangs of a material handling device, or the like, to be inserted therethrough. It will be appreciated that the clearance holes 110 may be configured differently, for example, to include straight corners which may be created by a steel rule die operation. The center cell 108 provides good stability across the axial direction of the core block 104 plus allows the runners 106 to be better stabilized around the fork openings 110. The resulting core block 104 adds yet additional rigidity to the overall internal structure 102 which, in turn, strengthens the overall pallet assembly 100. It will be appreciated that the elongated core block 104 may be adhesively bonded to one or both of the optional decks 16 or 18 or the base of the envelope with cutouts 110 being aligned with respective openings in the sidewalls of the envelope, in order to assure proper placement of the same. It should also be noted that preferably elongated core blocks 104 will be oriented so as to extend in a non-parallel angular relationship with the flutes of envelope 12 and also with respect to the flutes of the top deck 16 and bottom deck 18 if used. When elongated core blocks 104 are utilized in the embodiment shown in FIGS. 6 and 7 they will preferably be oriented so as to extend in a non-parallel angular direction with respect to the flutes of the envelope and also at least one of the top and bottom decks if present.

Figure 11:
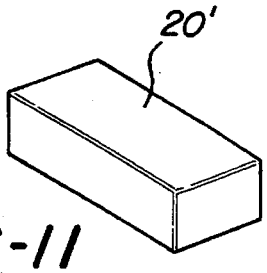
FIG. 11 is a perspective view of another alternative embodiment illustrating a block made of material other than paper.

It will be further appreciated that the above embodiments may employ other reinforcing structure members besides the core blocks 20 and 104 that are specifically disclosed herein. For example, either solid or other lightweight structural support members may be used in various combinations within the internal structural assembly 102. More specifically, foam blocks or other lightweight material could be used individually or in combination with solid blocks 20' (see FIG. 11) such as wood, plastic or pressed sawdust, etc. In particular, it may be advantageous in some applications to incorporate a solid or lightweight block nested into each of the four corners of the pallet deck to enhance its ability to resist damage at these locations. Of course solid, lightweight or core blocks 20 and 104 can be intermixed in any desired combination depending upon the specific application. Thus, the scope of this invention encompasses the use of various types of structural blocks that may be used to enhance the overall rigidity and other performance features of the wrapped pallet deck assemblies 10, 70 and 100.

The foregoing discussion discloses and describes merely exemplary embodiments of the present invention. It is reasonably contemplated and within the scope of this invention to combine the various aspects of the three embodiments disclosed herein in order to produce yet another embodiment. Nonetheless, one skilled in the art will readily recognize from such discussion, and from the accompanying drawings and claims, that various changes, modifications and variations can be made therein without departing from the spirit and scope of the invention as defined in the following claims.

What is claimed is:

1. A paperboard deck pallet assembly comprising:

a one-piece envelope including an upper panel, a lower panel and corrugated components disposed therebetween that define flutes extending in a first direction of said envelope, said envelope further having a base portion that is smooth, four integrally formed side wall portions extending vertically from said base and four tab portions that abut one another to define a smooth continuous top surface;

a reinforcing structure disposed within said envelope for adding rigidity to the pallet assembly and supporting said top surface in spaced relationship to said base, whereby said base, said side walls and said tabs share continuous flutes, and when in a folded condition the flutes of said base and said side walls being oblique with one another, the flutes of said side walls and said tabs being oblique with one another, and the flutes of said base and said tabs being perpendicular to one another.

2. The pallet assembly as in claim 1 further including a first deck positioned within said folded envelope, said tabs being secured to said deck.

3. The pallet assembly as in claim 2 wherein said first deck has flutes extending in a direction substantially perpendicular the flutes of said tabs.

4. The pallet assembly as in claim 1 wherein said side walls have an opening for receiving tangs of a material handling apparatus.

5. The pallet assembly as in claim 1 wherein said reinforced structure is comprised of a pair of spaced-apart multi-ply structures being interconnected by a honeycomb-shaped structure.

6. The pallet assembly as in claim 1 wherein said tabs are secured to a first deck disposed within said folded envelope to define a substantially flat top surface.

7. The pallet assembly as in claim 1 wherein the envelope is formed from a unitary piece of material and, when folded, has smooth external surfaces.

8. A pallet comprising:

a) a foldable blank having a first ply, a second ply and a filler component positioned therebetween, said filler component defines flutes extending the length of said blank, the blank when in a folded condition comprising:

a base, vertically extending side walls connected to said base and extending around each peripheral edge of said base, a plurality of flaps having edges that are nested together to define a smooth top surface, said flaps extending from an upper edge of each of said sidewalls, said flaps having flutes extending in a first direction, said vertically extending side walls having flutes that extend in a second direction oblique from the flutes in the flaps; and b) an inner structure positioned within said folded blank comprising:

a first flat deck nested within the blank, said first flat deck having flutes extending in a non-parallel angular direction with respect to said first direction, selected ones of said flaps being secured to said first deck, a block adjacent said deck for adding strength to the pallet.

9. The pallet as in claim 8 further comprising a second flat deck located adjacent to said base.

10. The pallet as in claim 9 wherein said second deck includes flutes extending in a non-parallel angular direction with respect to said flutes of said base.

11. The pallet as in claim 9 wherein said blank is an envelope and said first deck, said second deck and said block defines an internal assembly that is rigid and may be inserted within said envelope.

12. The pallet as in claim 11 wherein said envelope encapsulates the internal assembly, which together, defines a rigid deck pallet.

13. The pallet as in claim 11 wherein said envelope is a unitary member made of paperboard and is formed to have a base, side walls and a top surface that are substantially smooth.

14. The pallet as in claim 8 wherein said side walls include openings operable to receive tangs of a material handling device.

15. The pallet as in claim 8 wherein said inner structure is further comprised of a plurality of spaced-apart blocks that are bonded to said deck.

16. The pallet as in claim 15 wherein selected ones of said blocks are formed of paperboard.

17. The pallet as in claim 15 wherein said pallet has a length and a width, each said plurality of blocks extending the entire dimension of one of said length and width.

18. The pallet as in claim 17 wherein said pallet includes four sidewalls, each of said sidewalls having a pair of spaced openings adapted to accommodate tongs of a material handling device and each of said plurality of blocks includes a pair of cutout portions aligned with a respective pair of said openings in said sidewalls.

19. A wrapped paperboard pallet assembly comprising:

a unitary envelope having integrally formed portions defining a bottom, sidewalls, and a plurality of top flaps, said sidewalls extending upwardly from and being coextensive with each of the peripheral edges of said bottom one of said plurality of flaps being integrally formed with and coextensive with an edge of each of said sidewalls, said plurality of flaps cooperating to form a substantially smooth top surface, each of said flaps including flutes;

a deck positioned within said envelope, said deck structure having flutes extending in a non-parallel angular relationship to said flutes of said flaps, selected ones of said flaps being secured to said deck; and a plurality of blocks positioned in spaced relationship within said envelope and extending between said bottom and said deck, each of said blocks having a longitudinal axis extending in a non-parallel angular relationship to said flutes of said flaps.

20. The pallet assembly as in claim 19 wherein said flaps overlap one another and wherein said flaps have edges that nest together to define a smooth top surface.

21. The pallet assembly as in claim 19 further comprising another deck structure that is secured to said blocks, said decks and said blocks together define an internal structure assembly that adds rigidity to the pallet assembly.

22. The pallet assembly as in claim 21 further comprising blocks that are secured to said decks to enhance rigidity of said pallet assembly, each of said blocks having a honeycomb like structure.

23. The pallet assembly as in claim 19 wherein selected ones of said blocks are made of two spaced-apart panels bonded to a reinforcement member positioned therebetween.

24. The pallet assembly as in claim 19 wherein each of said sidewalls include a pair of spaced openings adapted to accommodate tongs of a material handling device.

25. The pallet assembly as in claim 24 wherein said blocks are disposed in parallel spaced relationship with each other and with two of said sidewalls, each of said blocks having a pair of cutout portions aligned with said openings in said sidewalls.

26. A pallet assembly comprising:

a first generally planar member defining a top surface, said first member having a length and a width and flutes extending along a first direction;

a second generally planar member defining a bottom surface, said second member having a length and width substantially equal to said length of and width of said first member, said second planar member further having flutes extending in a second direction that is non-parallel to said first direction;

a plurality of blocks secured in general parallel spaced relationship between said first and second members, each of said blocks having a length substantially equal to the length of said first and second member, said blocks further having a longitudinal axis that is in non-parallel angular relationship to one of said directions; and a pair of cutout portions spaced along the length of each of said blocks, respective ones of said cutout portions of each of said blocks being aligned in the direction of the width of said first and second members, said cutout portions being adapted to accommodate tongs of a material handling device when said tongs extending in the direction of the width of said first and second members and the spacing between respective ones of said blocks being adapted to accommodate the tongs of a material handling device when said tongs extend along the length of said first and second members.

27. The pallet as in claim 16 wherein other of said blocks are formed of a non-paperboard material.

* * * * *